United States Patent [19]

Shields

[11] Patent Number: 4,953,355

[45] Date of Patent: Sep. 4, 1990

[54] METHOD AND APPARATUS FOR VARIABLE PROPORTIONAL WEIGHT LIFTING EXERCISES

[76] Inventor: William D. Shields, 3031 Dalehurst Dr. West, Jacksonville, Fla. 32211

[21] Appl. No.: 353,784

[22] Filed: May 18, 1989

[51] Int. Cl.[5] ..... A63B 21/062

[52] U.S. Cl. ..... 272/118; 272/134

[58] Field of Search ..... 272/117, 118, 123, 134

[56] References Cited

U.S. PATENT DOCUMENTS

| | | | |
|---|---|---|---|
| 3,912,261 | 10/1975 | Lambert, Sr. | 272/118 |
| 4,538,805 | 9/1985 | Parviainen | 272/117 X |
| 4,546,971 | 10/1985 | Raasoch | 272/117 X |
| 4,809,973 | 3/1989 | Johns | 272/118 |
| 4,834,365 | 5/1989 | Jones | 272/118 |

*Primary Examiner*—Robert W. Bahr

*Attorney, Agent, or Firm*—Arthur G. Yeager

[57] ABSTRACT

A split phase cam-controlled weight lifting exercise machine employs two independently selectable weight stacks connected by cable and pulley assemblies to a respective phase of the cam. Exercise arms are pivotally mounted for pivotal movement of the cams to which are connected the cables in a manner to provide for a different moment arm for one loaded weight than for the other during a part of the exercise. The weight loading is selected by a pin that fits through the weights and a guide rod mounted so as to not contact the weights and cause friction that degrades the benefits of the split cam operation. The guide rod is mounted on bearings that limit movement to the vertical direction. The weights include integral interlocks to align them vertically in a stack.

64 Claims, 6 Drawing Sheets

METHOD AND APPARATUS FOR VARIABLE PROPORTIONAL WEIGHT LIFTING EXERCISES

BACKGROUND OF THE INVENTION

1. Field of the Invention

The present invention relates to exercise machines and in particular to machines that utilize pivotal cam action with selectable weights.

2. Prior Art

Exercise machines that utilize a cam action to achieve a weight loading proportional to an individual's strength at each point in an exercise motion are well known in the art. However, every individual's strength curve is not the same. For example, bone lengths are not the same. Furthermore, the same individual will find the strength curve varying even in the same workout. Standard cam machine's do not provide a way for the users to match the machine to their strength curve. In addition, if an individual is very strong or is involved in very heavy training, then the change in the strength curve through the range of motion will be greater than for those individuals doing higher repetitions for "toning". Exercise machines known in the prior art do not take into account the variations in an individual's strength curve or the change in the strength during an exercise motion or during a series of exercises.

SUMMARY OF THE INVENTION

In accord with the present invention there is provided an exercise device comprising a support frame including a plurality of rigidly secured members, at least one manually operable exercise means, for example, an exercise arm or cable, mounted to the frame in a manner to allow for movement thereof through a predetermined distance, at least one split phase cam means pivotally mounted to the frame for movement of the cam means about a pivot axis when the arm or cable is manually operated and at least two weight stack means each including a plurality of selectable weights. A pair of elongated means is provided for operatively connecting each weight stack means to the split phase cam means for movement of respective weight stack means by pivotal movement of respective cam means. A pair of connection means is included for connecting one elongated means to the cam means at a connection point on one phase spaced from a connection point for another elongated means on the other phase so that the moment arm from one connection point to the cam means pivot axis is initially greater than the moment arm from the other connection point to the cam means pivot axis through a portion of the predetermined distance. The cam means includes a pair of rigidly connected cam elements, each cam element being a single phase and having a planar body portion and a perimeter rim portion, with one connection point being on the rim portion of one of the cam elements, the other connection point being on the rim portion of another cam element. A cam shaft is rotatably mounted to the frame and rigidly secured to the arm or cable and movable therewith. Selection means is also provided for manually selecting one or more of the weights in each respective weight stack means for movement by the cam means. The elongated means includes a pair of cables each having opposite end portions and includes a guide means mounted to the frame and having opposite end portions operatively coupled at one end portion to the other end portion of a cable and including selection means for selectively connecting one or more of the weights in a respective weight stack means to respective guide.

The weights include an upper surface and a lower surface and a vertical passageway communicating therebetween with the guide means being disposed within the passageway of each weight and are spaced sufficiently to provide clearance between the guide and the weights. Positioning means are mounted to the frame to inhibit lateral and pivotal movement of each guide. Another aspect of the guide means includes an elongated guide rod having an upper end portion and a lower end portion being bifurcated to a fork with a pair of spaced elongated elements each having upper and lower end portions, each element of respective pair being disposed closely adjacent a side of each weight of the weight stacks and are spaced sufficiently to provide clearance between the elements and the sides of the weights. The upper end portion of the fork i formed as a horizontally disposed bar which provides a seat for receiving an uppermost weight in each weight stack, each being spaced a sufficient distance to maintain the uppermost weight in a horizontal position. This guide also has means to inhibit lateral and pivotal movement of the rod which includes linear bearing mean including a housing mounted rigidly to the lower portions of the elements and having an elongated shaft rigidly mounted to the frame. Alternatively, a roller bearing is mounted on the frame for permitting only linear movement of the rod.

The weights also include bosses and indentations on the weights which cooperate as interlocks to inhibit lateral and pivotal motion of the weights. The elongated means includes a bracket seated against a boss on the exposed surface of an uppermost weight in each weight stack for inhibiting lateral and pivotal motion. The exercise device herein also includes a range of motion adjustment means to select the initial position of an exercise arm and stop means to limit the pivotal movement thereof.

The split phase cam concept in accordance with the present invention provides answers for all of the prior art problems set forth above. First, the machine allows individuals to match their own strength curve. Second, the machine allows the individual to match the strength curve as it changes during a series of exercises.

The split phase cam machine uses a cam split into two or more distinct phases and an independent weight stack for each phase of the cam. In most applications, the split cam phases complement each other and provide an action similar to a single cam. The weight stacks are labeled "starting" and "finishing" for the simple two-phase system. The machine, however, does not necessarily limit the stacks to the beginning and ending portions of an exercise motion.

The design also has unique benefits in rehabilitation, allowing a trainer to avoid stressing an injured joint while still taxing a muscle that is extremely well developed.

One cam phase exerts most of the effect over the initial range of motion with its own weight stack applied. The other cam phase exerts its effect during the "finishing" phase using its own weight stack. Accordingly, an individual can adjust the "starting" and "finishing" weight loadings individually and at any time during an exercise routine. Finally, the weight stacks can be arranged for movement in tandem or in opposition as may be appropriate for a particular exercise machine.

An exercise often used for "toning" is called "peak contraction". This technique emphasizes the "finishing" range of the exercise motion. The individual will hold the weight at the point of fully contracted muscle and then forcefully squeeze or contract the muscle and hold this action for a few seconds. The split phase cam machine also lends itself to this technique because an individual can select less "starting" weight and more "finishing" weight where it is needed.

Conventional weight stack machines also suffer from an additional disadvantage. They utilize a pair of guide rods on either side of the center rod used to select and lift the weights. This system adds a great deal of friction which is undesirable for a number of reasons. First, the exercise motion has a positive part—concentric contraction—when the muscle is being contracted during weight lifting and a negative part—eccentric contraction—when the muscle is slowly releasing the lifted weight. The friction in a convenient weight stack adds to the resistance during the positive part of the exercise thus requiring the exerciser to select less actual weight. In addition, the friction in the negative part of the motion reduces resistance during that phase. Both of these effects diminish the benefits of the negative phase of the exercise.

The friction-free weights used in accord with the present invention does not utilize the pair of guide rods found in the prior art. The selection post in the present invention doubles as the selecting mechanism and the guide mechanism and does not actually contact the weights in a respective weight stack. The guide rod or selection post herein extends to a point below the weight stack where it is held to only vertical movement by bearings. The weights have further interlock means to align them properly in the weight stack.

The present invention thus provides for substantial improvements in an exercise machine over the devices known in the prior art.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
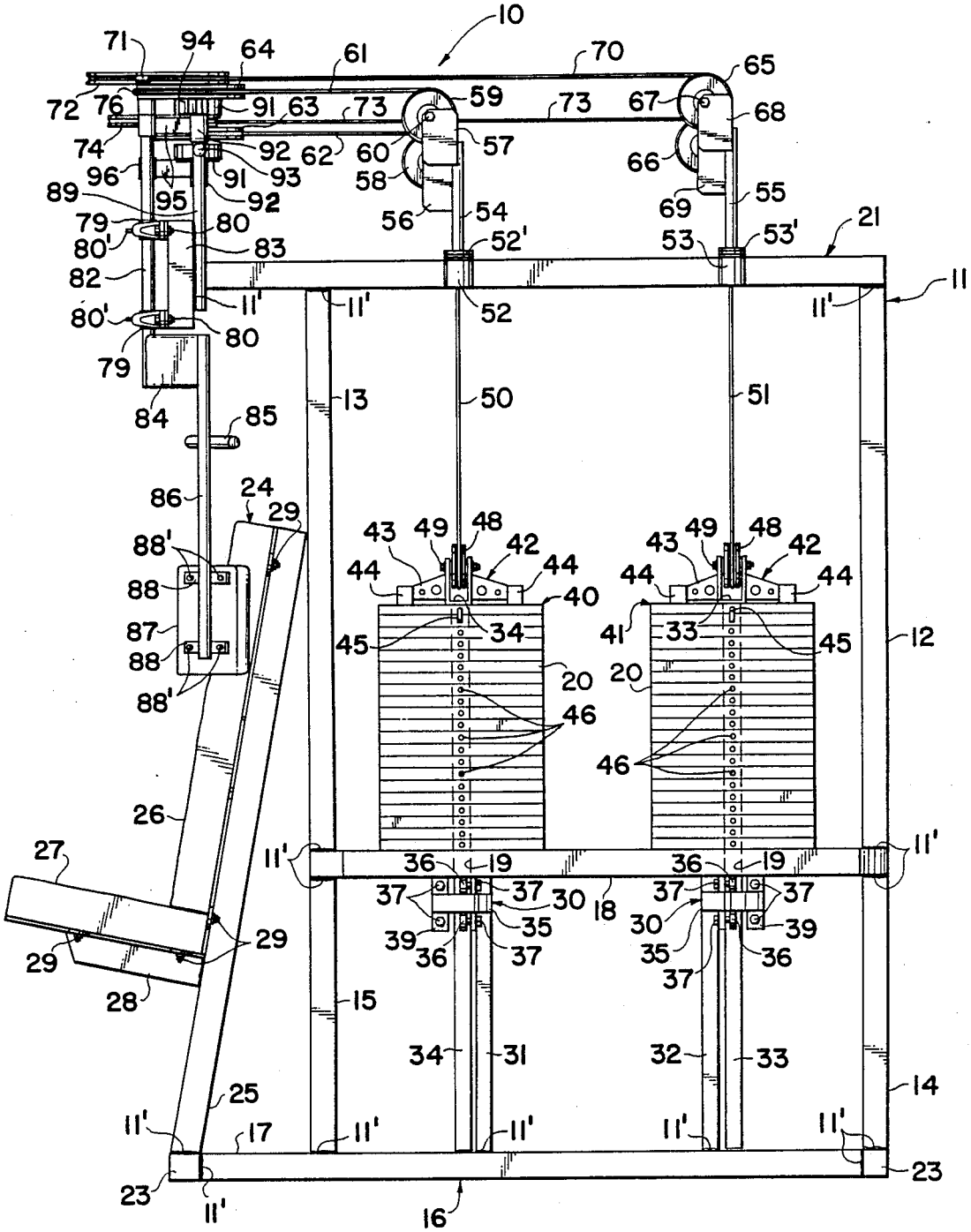
FIG. 1 is a side elevational view of one embodiment of a split phase cam exercise machine in accord with the present invention.
Figure 2:
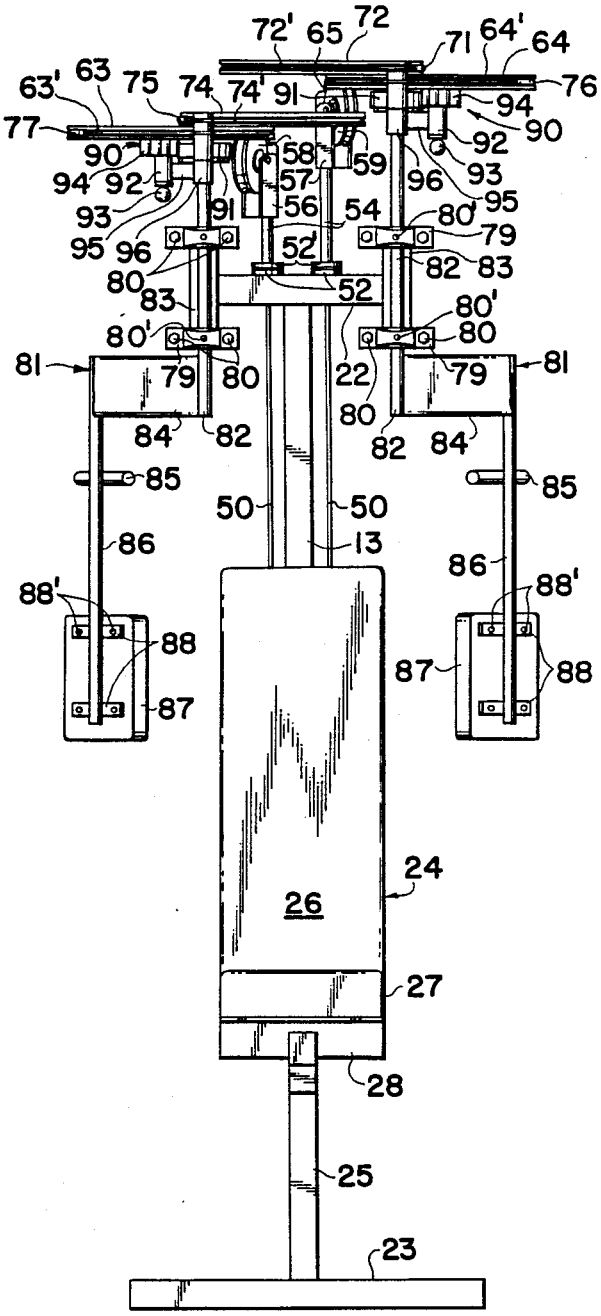
FIG. 2 is a front elevational view of the machine in FIG. 1.
Figure 4:
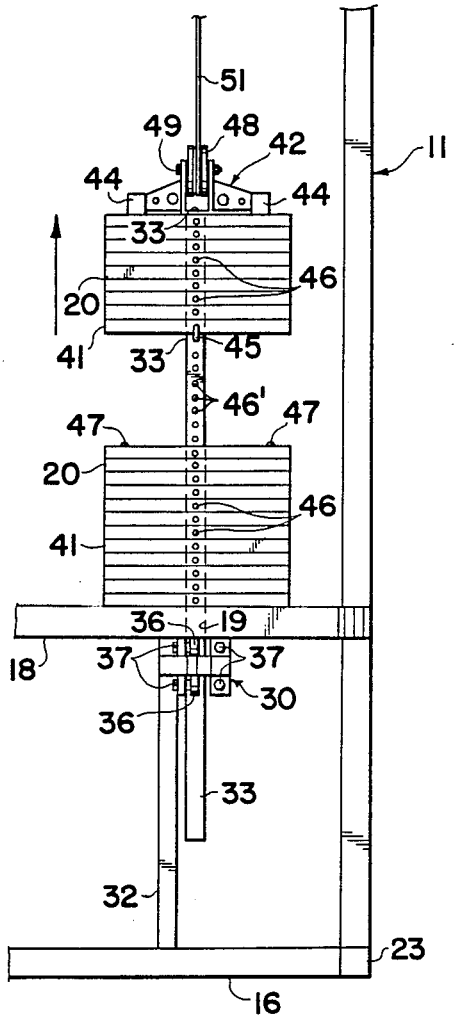
FIG. 4 is a partial elevational view of a lifted weight stack of FIG. 3.
Figure 3:
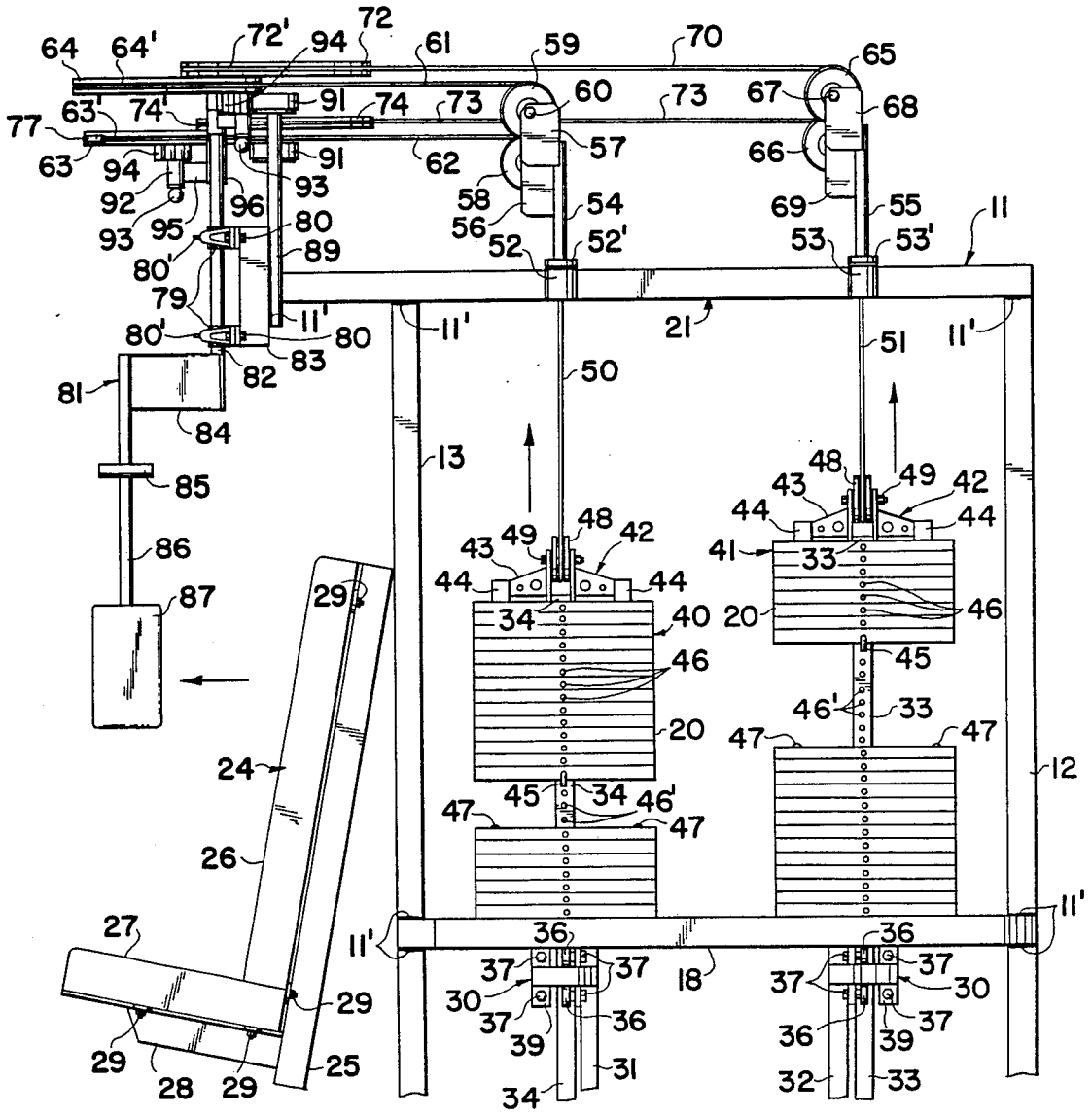
FIG. 3 is a side elevational view of the machine in FIG. 1 during a point in an exercise motion.

Referring now to the drawing, the exercise device in accord with the present invention is depicted at numeral 10 in FIG. 1. The exercise device 10 includes a steel frame 11 with the associated members all welded with only a few of the welds 11' shown for simplicity of illustration. The frame 11 includes a vertical rear and front member 12 and 13, respectively, each of which have lower members 14 and 15, respectively. A lower floor frame member 16 is welded between the members 14 and 15 and includes a forwardly disposed extension 17. A weight support frame member 18 is welded between members 12 and 13 and is approximately four inches wide. Two identical circular holes 19 are drilled through member 18 for passage of a guide mechanism as will be discussed hereinbelow. The uppermost frame member 21 is also welded between frame members 12 and 13. The front end of frame member 21 has a welded cross member 22 thereon as shown in FIG. 2. FIG. 2 also illustrates the use of lateral floor members 23 which provide for increased stability of the frame 11. Members 23 may be of the same or different length as may be desired in the circumstances.

A seat assembly 24 is attached to the front of the frame 11 between lower extension 17 and frame member 13 via seat support member 25. The seat assembly also includes a seat back 26, a seat cushion 27, a cushion frame 28 welded to support member 25, and a plurality of bolts 29 for securing the seat back 26 and cushion 27 to the supports 25 and 28.

Mounted to the bottom of weight support member 18 are roller bearing assemblies 30 which provide for low friction alignment and stability of the guide rods 33 and 34. Additional weight support is provided by vertically disposed support members 31 and 32 which are welded between members 16 and 18. Members 31 and 32 also support roller bearing support brackets 36 of which there are two per guide rod 33 and 34, one on either side. Bearing housings (not shown) are connected via bolts 37 to brackets 36 and 39.

Figure 6:
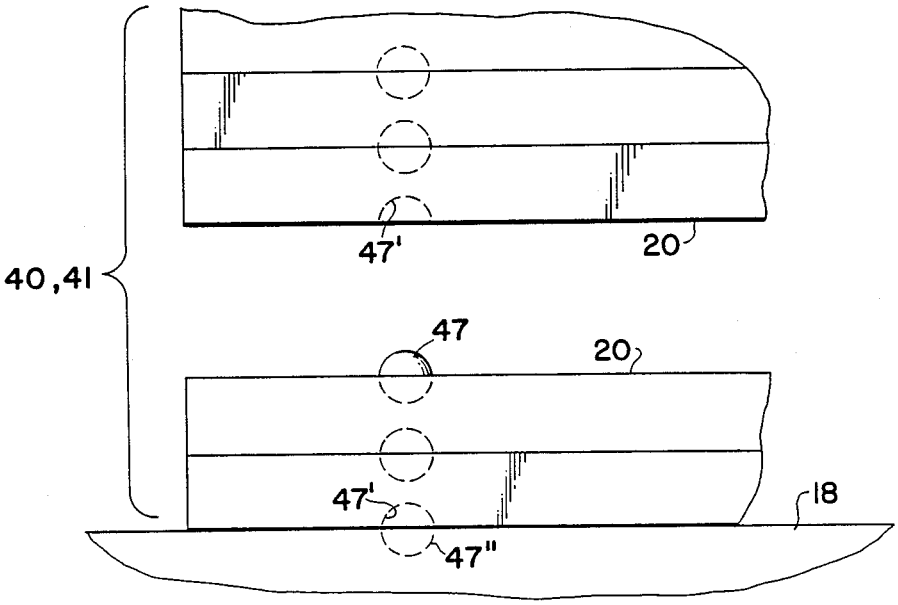
FIG. 6 is a partial view of the interlock mechanism used to align the weights used in FIG. 1.

Forward weight stack 40 and rearward weight stack 41 preferably utilize identical metal weight plates 20 which are approximately four inches wide and between two and twenty four inches long. Lower bosses or dowels 47'' provide alignment of the weight stacks 40, 41 by inhibiting lateral and pivotal movement of the lowermost weight plate 20. The number of weights 20 that are selected in each stack 40, 41 are selected via pin 45 and raised via identical lifting assemblies 42. Each lifting assembly 42 has a lift bracket 43 with downwardly disposed bosses 44 which act to inhibit pivotal movement of the uppermost weight plates 20 on the respective stacks 40, 41. Each weight plate 20 has a horizontal hole 46 drilled therethrough. Each guide rod 33 and 34 also has a series of vertical aligned holes 46' to allow for weight selection via pins. As illustrated in FIG. 6 the weights 20 have a boss 47 upstanding on the upper surface and an indentation 47' on the lower surface. The boss and indentations 47, 47', 47'', respectively, cooperate as interlocks to inhibit lateral and pivotal motion of weights 20 with respect to each other and to the frame member 18. Preferably the bottom surface of bosses 44 also include indentations similar to 47' to further inhibit pivotal movement of the uppermost weights 20. Guide rods 33 and 34 are welded or bolted to a respective lift bracket 43. The lifting assemblies 42 also include pulleys 48 mounted thereon via axles 49. When a group of weights 20 are selected via pins 45, the stack of weights 20 that are to be lifted are held against each other via the interlocks 47, 47' and bosses 44. Roller bearing assemblies 30 act to inhibit lateral and pivotal movement of the guide rods 33 and 34. Accordingly, when the selected weights 20 are being vertically moved, there is no lateral or pivotal movement of the selected weights 20 and they can be easily returned to their original stored position and remain aligned without any further action by the user.

Lifting force is applied to each weight stack 40, 41 via a cable 50 and 51, respectively, that is looped around the pulleys 48. The cable 50 extends vertically through a pulley support flange 52 with a bushing 52' therein to which is attached pulley support post 54 which, in turn, supports a pulley housing 57 onto which is mounted pulley 59 via axle 60. The rear weight cable 51 similarly extends vertically through pulley support flange 53 having bushing 53'. Pulley support post 55 is mounted in bushing 53' and supports housing 68 to which pulley 65 is mounted via axle 67. Pulleys 58 and 66 are similarly mounted in housings 56 and 69 respectively, which are mounted on support posts 54 (see FIG. 2). The cam pulleys 58, 59, 65 and 66 are pivotally mounted into support flanges 52', 53' in order to be rotatable during the pivotal movement of the cams as will be described hereinbelow. Flanges 52 and 53 are welded to the sides of upper frame member 21.

The cables 61 and 62 are integral with and extensions of cable 50 but are numbered separately for ease of explanation. The ends of cables 61 and 62 are connected to cams 64 and 63 respectively, via cable stops 76 and 77, respectively. Cams 63 and 64 include sheet metal channels 63' and 64' respectively, welded on the perimeter. Cable stops 76 and 77 are brackets that a respective cable end fits in and is further secured into place via a pair of allen screws as understood in the art.

The connections to rearward weight stack 41 is the same as for forward stack 40. Cables 70 and 73 are integral extensions of cable 51 and are connected to cams 74 and 72 via cable stops 71 and 75, respectively, which are mounted in perimeter cable channels 74' and 72'.

Figure 5:
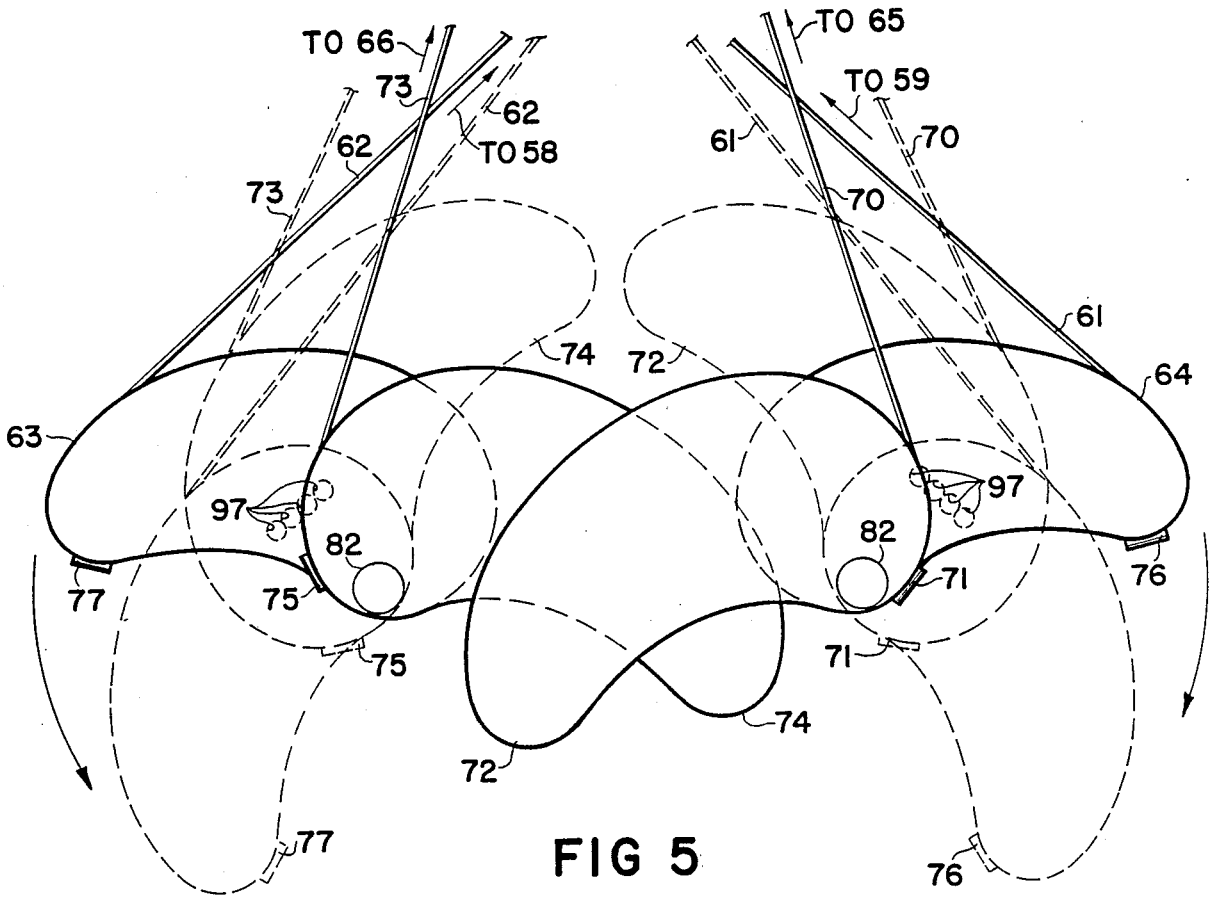
FIG. 5 is a top plan view of the split phase cam assembly shown in FIG. 1.

With reference now to FIG. 5, the respective cam pairs comprise two cams 63, 74 and 64, 72 mounted in superposition and welded together to pivot as a single unit. The solid line drawing represents the initial position. It can be seen that the moment arm from the cam pivot axis of cam shaft 82 to cable stops 76 and 77 is initially greater than the moment arms from the axis to cable stops 71 and 75. As the cams are rotated as indicated by the arrow, force is applied to lift forward stack 40 via the pull on cables 61 and 62. The force then lifts the selected weights 20 in forward stack 40 by raising pulley 48. Similarly force is also applied to cables 70 and 73 which pulls on cable 51 applying lifting force to the rearward stack 41. As can be seen in the broken line position, the moment arms continuously change length at a rate determined by the cam profile defined by the curvature of the respective cam perimeters as the cables 61, 62 and 70, 73 wrap against the respective perimeter channels 64', 63', 72', 74'.

With reference now to FIGS. 1 and 2, the exercise arms 81 are used to rotate the cam shafts 82 through the exercise motion. Exercise arms 81 are mounted by bearing clamps 79 and bolts 80 to a cam shaft support frame member 83 welded to cross member 22. Grease fittings 80' are preferably used for smooth pivotal motion and to extend the life of the machine 10. Arms 81 include horizontal member 84 to extend outwardly the lower member 86 to which handhold 85 is welded. Arm pads 87 are secured to member 86 via brackets 88 and screws 88'.

An exerciser sits on seat assembly 24 and operates the exerciser arms 81 through the desired exercise routine. Cam shafts 82 are welded to the respective cam pair. The range-of-motion adjustment assembly 90 includes a pin boss 94 welded to the cams 63 and 64. A push pin 93 is mounted in push pin sleeve 92 which is secured by arm 95 to sleeve 96. An exerciser can position pin 93 into a desired pin slot 97 (see also FIG. 5) to control the initial position of the exercise arms 81. This feature is useful for users who may have difficulty in extending their arms rearwardly to the maximum travel limit. Rubber stops 91 are contacted by pin boss 94 when the exercise machine 10 is not being used. The stops 91 are mounted on support posts 89 which are welded to frame member 22.

The preferred embodiment illustrated is designed for use in exercising the chest muscles. Both arms 81 are used either individually or together. The cable and pulley assembly is used to attach the weight stacks 40, 41 to cables 50, 51. Cables 50, 51 could be attached directly to the brackets 43 in a machine 10 designed for different exercises.

As understood in the art of cam mechanisms, a given cam mechanism is composed of at least three links: (1) a cam, which in this case is a disc cam comprised of a plate of steel or aluminum cut to the desired shape; (2) a follower, which in this case comprises the cable and pulley assembly and the respective stack of weights; and (3) a frame, which supports and guides the cam and follower.

All cams can be regarded as wedges having a surface of either uniform or variable slope. A given cam element 63, 64, 72, 74 can be described as a circular disc with the wedge of variable slope attached around the perimeter. The slope of the wedge portion defines the profile of the cam 63, 64, 72, 74. It is therefore convenient to describe the operation of a cam mechanism in terms of a "displacement diagram" which is a linear curve in which the abscissa represents the cam displacement in degrees and the ordinate represents the follower displacement in inches. This latter quantity is sometimes referred to as "lift" even though the action need not be vertical.

When a cam is rotated through a given angle, the follower may move with either constant velocity or constant acceleration. However, acceleration that lasted to the end of follower travel would result in maximum velocity being attained just before the follower comes to rest.

As discussed hereinabove, as the arms 81 are pivoted from an initial position, the cam shafts 82 will begin to rotate the respective cam pair. The front weight stack 40 is attached via lift assembly 42 to cables 61 and 62 which attach at stops 76 and 77 to cams 64 and 63, respectively. The greater moment arms from the cam pivot axis of cam shafts 82 to the connection points of stops 76 and 77 during the initial movement of exercise arm 81 means that the exerciser utilizes the selected weight of forward stack 40 during this range of the exercise motion. The moment arms to stops 71 and 75 are practically zero at this time. As the cam shafts 82 rotate and cause the cables to wrap around and against their respective channels, the respective moment arms will vary with the cam profile. In the illustrated preferred embodiment, the moment arms associated with forward weight stack 40 are initially at a maximum and the moment arms associated with rearward weight stack 41 are at a minimum. As the cam shafts 82 rotate, the forward weight stack moment arms decrease while the rearward weight stack moment arms increase. At the maximum travel movement, the moment arms have "changed over" and the forward moment is near zero while the rearward moment arm has reached its maximum. From the view point of the conventional displacement diagram, the displacement curve for the rearward weight stack cam action is out of phase with respect to the displacement curve of the forward weight stack cam action and accordingly, the combined cam action can be referred to as "split phase". Preferably, the cams 63, 64, 72 and 74 are identical in shape and arranged symmetrically to provide that the moment arms "change-over" in value during the exercise motion and at the point where the exercise arms 81 reach the travel limit, the rearward weight stack moment arms have attained a maximum and the forward moment arms have declined to a minimum. It is understood that different cam profiles may be used to provide for different phase relationships, moment arm variations and "change-over points" as appropriate. The location of the cable stops 71, 76, 75, 77 with respect to each other and with respect to the cam profile establish both the initial and final moment arms and cooperate with the cam profile to establish the moment arm rate of change. Thus, it can be seen that the weight loading of a weight stack 40, 41 can become dominant at a specific point in the exercise motion and that the weight stacks 40, 41 can travel at different velocities during the exercise motion. In addition, the split phase design of a particular cam pair can be extended to three or more cam element phases each connected to a corresponding weight stack of independently selectable weight loading. Furthermore, the user can select the weight loading to achieve a resistance level of a particular amount for the specific points where a weight stack 40 or 41 is dominant (or, for that matter, where a combination of weight stacks are dominant). Finally, the cam profiles can be shaped to provide a rapid "change-over" of dominance from one or more weight stacks to other weight stacks in a particular exercise machine.

Thus, it can be seen that a particular exercise machine 10 can be utilized by persons seeking widely different weight loading arrangements by simply using the selector pins 45 to select the appropriate weights 20 in the stacks 40, 41 for his or her particular needs. Specifically, the resistance curve of the total selected weights, which can be represented by the sum of the respective displacement curves through the exercise motion, can be set to match the individual's strength curve continuously throughout the exercise motion and thereby provide the user with the full potential benefits of the exercise. These various weight loading arrangements are simply not possible on single cam/single connection machines known to the prior art.

In the illustrated preferred embodiment, exercise is accomplished via exercise arms 81 because this particular machine 10 is designed for chest exercises. It is to be understood that cables, levers, or platforms may be connected to cam shafts 82 in other exercise machines. Furthermore, the cable and pulley assemblies used in the illustrated machine 10 are adapted for the translation of the rotational arm motion of arms 81 to vertical lift motion of the weight stacks 40, 41. As understood in the art, there are any number of arrangements that could be substituted to the cable and pulley assemblies without departing from the essential characteristics of the present design.

Figure 7:
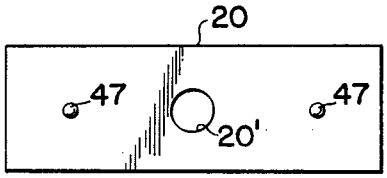
FIG. 7 is a top plan view of a weight used in FIG. 6.

Conventional weight stacks utilize weight plates with three holes. The center hole is used with a center guide rod for the selection of weights to be used. The entire weight stack would be guided by two other guide rods that fit through holes on either side of center. The principal disadvantage of such an approach is the friction encountered both during lifting (the "positive" phase) and during release (the "negative" phase). During the lifting of the selected weights, friction results in greater resistance to the lift with the result that an exerciser will select less actual weight. Secondly, during the controlled release of the lifted weights, friction will act to retard release thus reducing resistance to the user. This has the effect of making it appear that less weight is being used and thus detracts from the "negative" phase of an exercise. In the present invention, the weights 20 have center holes 20' cut therethrough wide enough for passage of a guide rod 33, 34, as shown in FIG. 7. Guide rods 33 and 34 do not physically contact the weights 20 whether selected for lifting or remaining in the stack 40 or 41. Roller bearing assembly 30 provides a low friction method of holding a guide rod 33 and 34 when it is moved vertically to inhibit lateral or pivotal movement. Preferably, the guide rods 33 and 34 are made of square bar steel and will be of sufficient strength for the application. Accordingly, the only friction associated with operation of the machine 10 is that associated with the bearings of the various movable components. This friction is very low and does not affect operation of the device 10 unlike the machines of the prior art.

Figure 8:
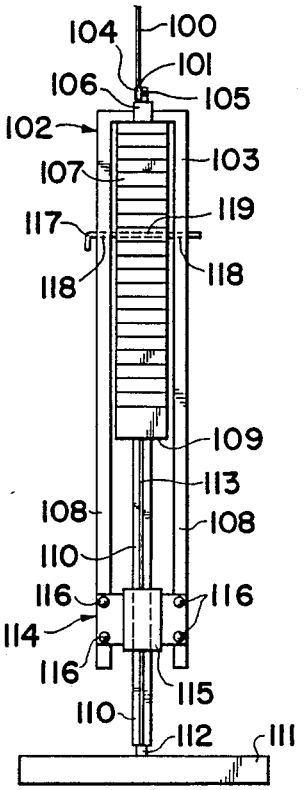
FIG. 8 is an end elevational view of a weight stack-/lift assembly used in an alternate embodiment of the invention.
Figure 9:
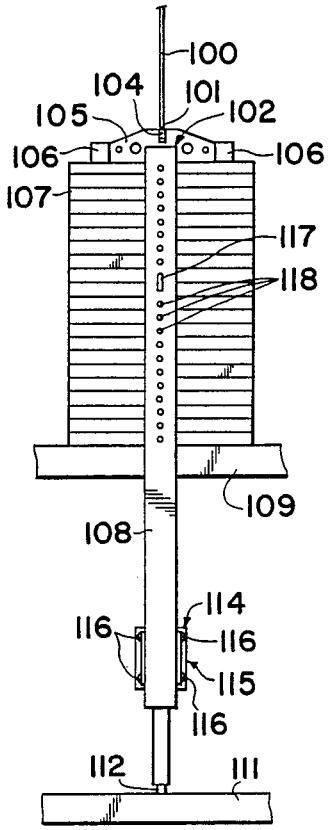
FIG. 9 is a partial side elevational view of the assembly of FIG. 8.

An alternate embodiment of the weight selection and guide rod assembly is illustrated in FIGS. 8 and 9. A cable 100 has a lower end portion 101 that is connected to a guide rod 102 at its upper portion 103 by a cable stop 104. The cable stop 104 includes a bracket and allen screws as understood in the art or whatever means are appropriate. The guide rod 102 includes a bracket 105 having end bosses 106 seated against the uppermost weight 107. Guide rod 102 is further bifurcated to form a fork with two downwardly disposed elements 108 that are located near the weights 107 but spaced a sufficient distance away to avoid contact and thus eliminate the associated frictional drag.

Weights 107 include bosses 47 and indentations 47' to provide an interlock so as to inhibit lateral or pivotable movement of the weights 107. The weights rest on elevated horizontal frame member 109 which, in turn, is supported in part by a support shaft 110 mounted on a lower frame member 111 via a member 112 such as a bolt or post welded to frame member 111. The support shaft 110 includes a groove 113 into which fits the rotatable balls (not shown) of linear bearing 114 which includes a housing 115 mounted to guide rod elements 108 via bolts 116. As cable 100 is pulled vertically via a cam assembly, guide rod 102 moves vertically with rotational or lateral movement inhibited by the linear bearing 114. The desired number of weights 107 are selected by using selection pin 117 which fits through holes 118 in guide rod elements 108 and through a horizontal passageway 119 in each weight 107. Bracket bosses 106 preferably include indentations similar to 47' to engage bosses 47 on the uppermost weight 107. Bosses 47" will also be used on the lowermost weight plate 107 if required in the circumstances.

In this embodiment two weight stacks are used for the "starting" and "finishing" phases of an exercise motion for the reasons discussed hereinabove. The cables 100 connect to the lifting assembly bracket 105 by stop 104 rather than a pulley 48 in this embodiment. This arrangement is used for machines 10 adapted for use in leg exercises wherein the legs do not move toward each other as do the arms in a chest exercise.

The present invention also contemplates the use of the bifurcated fork guide 102 with pulleys 48 as may be appropriate for a particular exercise motion.

Figure 10:
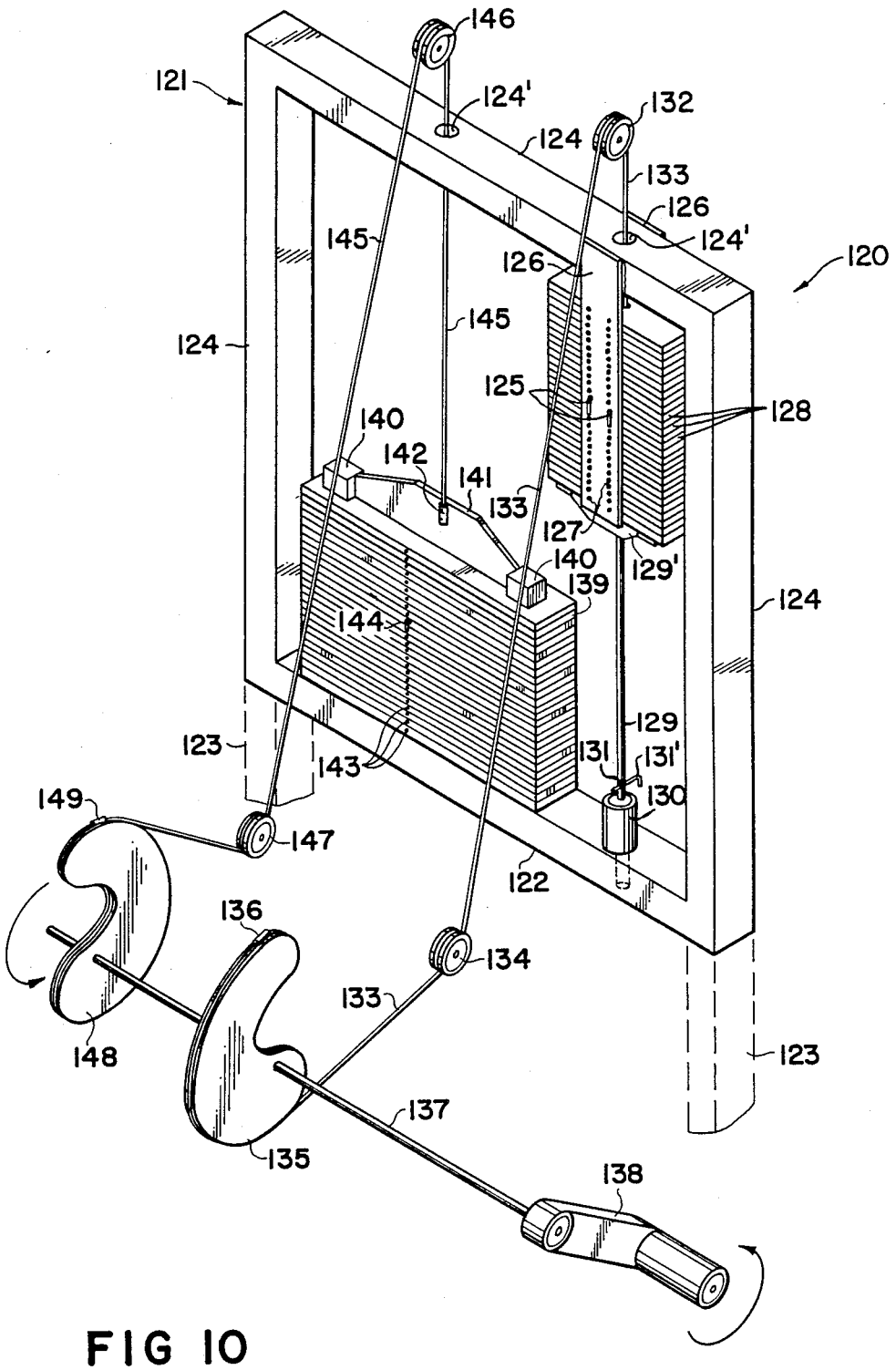
FIG. 10 is a simplified pictorial view of an alternate embodiment of the present invention.

Turning now to FIG. 10, an alternate to the straight tandem lift machine 10 discussed hereinabove is illustrated at 120. A frame 121 includes welded frame members 124 with an elevated weight support member 122 which is in turn supported on members 123. The upper member 124 has two holes 124' drilled therethrough. Two weight support and selection frame members 126 are welded on upper member 124 and they both include pairs of spaced vertically aligned selection holes 127 drilled therethrough. The pins 125 are used to select the number of counterweights 128 that will be used in a specific exercise routine. Counterweights 128 are supported on bracket 129' and guide rod 129. Preferably, bracket 129' is similar to bracket 105 and guide rod 129 is similar to rod 110. Guide rod 129 rides through a bearing 130 which preferably is a linear bearing such as bearing 114 and is connected at its upper end to cable 133.

The counterweights 128 are lowered via a cable 133 that passes over pulley 132 and under pulley 134. For ease of illustration, the pulleys 132 and 134 are shown without a housing or support post but are preferably mounted as illustrated in FIGS. 1–4. Cam 135 has cable 133 wrapped thereon and secured at cable stop 136. As cam 135 is rotated by, for example, leg raises on exercise arm or leg pad 138 which is mounted to cam shaft 137, counterweights 128 above the weight selected by pins 125 will remain in position. The weights 128 below the selected weight will be lowered vertically via the relaxation of tension on cable 133. Bearing 130 will prevent pivotal or lateral motion of the selected weights. Preferably, all counterweights 128 include the boss and indentation interlocks 47, 47' used on the weights 20 and 107.

The cam 148 works with cable 145 and lift weights 139 as discussed hereinabove. Bracket 141 includes bosses 140 which rest against the uppermost weight 139. Cable 145 is connected to bracket 141 via cable connection 142. Pin 144 is used with selection holes 143 to select the desired lift weights 139. The guide rod for the lift weights 139 may either be the square rod 33, 34 with roller bearings 30 as illustrated in FIGS. 1–4 or may be a round rod 110 with linear bearing 114 and is not shown for simplicity of illustration. Also, interlocks 47, 47', 47" will aid in stack alignment.

Cable 145 is wrapped over pulley 146 and under pulley 147 (supports not shown) and is attached to cam 148 at stop 149. In the illustration, cams 135 and 148 are identical and mounted on cam shaft 137. As an exerciser rotates the arm 138, weights 139 are lifted and counterweights 128 are lowered in order to achieve a desired resistance through the exercise motion. The selection of weights 128, 139 and the shape of cams 135, 148 define the total displacement curve and therefore the resistance. As before, the cams 135, 148 can be shaped to provide for different velocities and different points of dominance for the respective weight stacks 128 and 139. This design thus allows for a resistance curve that matches the strength curve of the exerciser. The friction-free guide rod selection apparatus also prevents friction in the machine 120 from interfering with either the positive or negative portions of an exercise motion. Machine 120 utilizes a "split phase" cam operation as do the machines illustrated in FIGS. 1–9.

Guide rod 129 has a hole 131 drilled therethrough for the passage of pin 131' which fits therein and rests against the bearing 130. Pin 131' is used to store the counterweights 128 in the raised position. Pin 131' also works in conjunction with the dual pin arrangement of pins 125 to make weight selection fast and convenient. Stops to limit the travel of cam shaft 137 may also be included as appropriate.

In practice, the illustrated machines would be marked so that a user would understand the characteristics of the cam assemblies employed in the specific device and would, accordingly, be able to tailor the weight loading curves for his or her exercise routines.

Finally, the illustrated machines employ weight stacks connected to cams that are symmetrical or nearly so. However, it is to be understood that a machine 120 could utilize a radically different profile for cam 135 in contrast to cam 148 to provide a weight loading action of the selected counterweights 128 which creates unique resistance curves that are not possible in single cam/single weight stack exercise machines.

In summary, the exercise device in accord with the present invention comprises a support frame including a base and a plurality of rigidly connected members, first and second exercise arms each movably mounted to the frame; first and second planar cams each having a split phase or two or more phases rigidly mounted on respective exercise arms and pivotable about a pivot axis through a predetermined distance when the respective arm is moved, a first and second stack of selectable weights each including a plurality of planar weight plates, each stack of weights being positioned on one member of the frame generally parallel to and spaced above said base, an elongated means including a first and second cable and pulley assembly mounted on the support frame for connecting via connection means, the first weight stack to the first and second cams at the appropriate phases and connecting via connection means the second weight stack to the first and second cams at respective phases. Each first and second cam includes an upper and lower cam element which are mounted in partial superposition about the cam pivot axis with the first cable and pulley assembly being connected at a point on the upper cam element of the first and second cams so that the moment arm from a respective cam pivot axis to the connection points of the second assembly is initially greater than the moment arm of the first assembly through a portion of the pivotal movement of the cams. Generally, the selected weight of one weight stack is dominant through a first range of pivotal movement of the cam means and the selected weight of another weight stack is dominant through a second range of pivotal movement of the cam means as determined by the profiles of the cam phases.

The elongated means also includes a pair of elongated guide means mounted to the frame and having opposite end portions, each guide means being operatively coupled at one end portion to respective first and second cable and pulley assembly, each guide means also including selection means for selectively connecting one of the weights in respective first and second stack of weights to respective guide means and any weights above the one weight being supported on and by the weight. Each weight includes an upper surface and a lower surface and a passageway communicating therebetween with the guide means being disposed within the passageway of each weight in respective stack of weights and positioned so that the guide means and respective passageways are spaced sufficiently to provide clearance between its guide and respective weights. Furthermore, positioning means is mounted to the frame to inhibit lateral and pivotal movement of each guide means. The weights include complemental cooperating interlock means between adjacent weights to maintain the weights in each stack in vertical alignment throughout the respective stack. The weights also include a horizontally extending passageway through opposing sides and each guide means may include a pair of elongated spaced elements on respective opposing sides of respective weights of a stack of weights, each pair of elements having a plurality of spaced horizontally aligned passageways. Selection means is included for each weight stack and includes a pin positionable in the aligned passageways of respective pair of elements and the passageways in one selected weight in each stack of weights. A pair of bearing means is attached between the elements and the frame to inhibit any movement of the elements other than vertical movement. The bearing means includes a housing and bearing mounted between the elements and an elongated shaft mounted to the frame and disposed within the bearing which is restricted in any rotational movement.

Also in accord with the present invention there is included a method of controlling the weight that is available to an exerciser during distinct periods of the range of motion of an exercise motion when using a split phase exercise machine including the steps of a. providing a stack of weights for each phase of a cam; b. mounting at least one split phase cam assembly on a pivot axis to be movable with the exercise arm; and c. attaching the stacks to a cam phase to provide a variable moment arm associated with a stack greater than a variable moment arm associated with the other stack during a range of the exercise motion. The method includes d. selecting the number of weights in the first and second stacks that are to be attached to the split phase cam assembly.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A method of changing the weight loading on an exercise element when the element is being operated during an exercise motion by an exerciser comprising the steps of:

A. mounting a cam means having a plurality of separate phases each having lift to be movable in response to the exercise element;

B. providing a stack of weights for each phase of the cam; and

C. moving each stack of weights independently in response to movement of the respective separative phase of the cam means providing predetermined velocities of movement of respective weight stacks during the exercise motion.

2. The method of claim 1 wherein step C includes the step of:

D. shaping the cam phases such that the velocity of at least one weight stack is different than the velocity of the other stacks during at least one portion of the exercise motion.

3. The method of claim 1 further including the step of:

D. shaping the lift of each of the cam phases such that the weight of two or more weight stacks is dominant with respect to at least one other weight stack at one specific portion during the exercise motion.

4. A method of controlling the weight that is available to an exerciser during two distinct portions of an exercise motion when using an exercise machine having a movable exercise element including the steps of:

A. providing a first stack of weights for one portion of the exercise motion and a second stack of weights for the other portion of the exercise motion;

B. mounting at least one split phase cam having a first and second phase on a pivot axis to be movable with the exercise element; and C. attaching the first and second stacks to the respective first and second phases of the cam to provide a first moment arm associated with the first stack greater than a second moment arm associated with the second stack during one portion of the exercise motion.

5. The method of claim 4 wherein step C includes the step of:

D. selecting the number of weights in the first and second stacks that are to be attached to the respective cam phase.

6. A method of changing the weight loading on a movable exercise element when the element is being operated during an exercise motion by an exerciser comprising the steps of:

A. providing a first stack of weights and a second stack of weights;

B. mounting a two-phase cam on a pivot axis to be movable with the exercise element; and C. attaching the first and second weight stacks to separate phases of the cam to provide for predetermined variations of the respective moment arms as measured from the cam pivot axis to the respective connection points of the first and second weight stacks.

7. The method of claim 6 wherein step C includes the step of:

D. selecting the number of weights in the first and second stacks that are to be attached to the cam.

8. The method of claim 6 further including the step of:

D. shaping the respective cam phases so that the velocity of movement of one weight stack is greater than the velocity of movement of the other stack during at least one portion of the exercise motion.

9. The method of claim 6 further including the step of:

D. shaping the respective cam phases so that the weight of one weight stack is dominant at one specific portion during the exercise motion.

10. In an exercise device comprising a support frame including a plurality of rigidly secured members, at least one manually operable exercise means mounted to said frame in a manner to allow for movement thereof through a predetermined distance, at least one cam means assembly pivotally mounted to said frame for movement of said cam means about a pivot axis when said exercise means is manually operated, at least two weight stack means each including a plurality of selectable weights, a pair of elongated means for operatively connecting each said weight stack means to said cam means for movement of respective said weight stack means by pivotal movement of said cam means, a pair of connection means for connecting one said elongated means to said cam means at a connection point spaced from a connection point for another said elongated means, each said connection point defining a respective moment arm with respect to said cam pivot axis.

11. In the exercise device as defined in claim 10 wherein said cam means is formed to have a profile that defines two distinct cam phases, one said connection point being on one said phase, another said connection point being on another said phase.

12. In the exercise device as defined in claim 11 wherein each said cam phase defines the variation of the respective said moment arm throughout said predetermined distance.

13. In the exercise device as defined in claim 11 wherein each said cam phase defines the velocity of movement of respective said weight stack means throughout said predetermined distance.

14. In the exercise device as defined in claim 13 wherein the velocity of movement of one said weight stack means differs from the velocity of other said weight stack means during at least one distinct portion of said predetermined distance.

15. In the exercise device as defined in claim 12 wherein one said moment arm varies from an initial minimum value to a maximum value as said cam means is rotated through said predetermined distance.

16. In the exercise device as defined in claim 12 wherein a selected weight of one said weight stack means is dominant at least one specific point in said predetermined distance.

17. In the exercise device as defined in claim 10 wherein said cam means includes a pair of cam elements, each said cam element having a planar body portion and a perimeter rim portion, said one connection point being on said rim portion of one of said cam elements, said other connection point being on said rim portion of another of said cam elements.

18. In the exercise device as defined in claim 17 wherein each said cam element is formed to have a profile that defines a cam phase, said pair thereby defining a split phase cam.

19. In the exercise device as defined in claim 10 further comprising a cam shaft rotatably mounted to said frame and rigidly secured to said exercise means and movable therewith.

20. In the exercise device as defined in claim 17 wherein said perimeter rim portion defines the profile of said respective cam element.

21. In the exercise device as defined in claim 10 further comprising selection means for manually selecting one or more of said weights in each respective said weight stack means for movement by said cam means.

22. In the exercise device as defined in claim 10 wherein said cam means includes a pair of cams, and means for mounting said cams on a single said cam pivot axis.

23. In the exercise device as defined in claim 22 wherein one said cam is rigidly affixed to the other said cam.

24. In the exercise device as defined in claim 10 wherein said pair of elongated means includes a pair of cables each having opposite end portions, one said cable being connected at one said end portion by said one connection means to said cam means and connected at another said end portion to one said weight stack means, another said cable being connected at one said end portion by said other connection means to said cam means and connected at another said end portion to another said weight stack means.

25. In the exercise device as defined in claim 24 wherein each said elongated means further includes a guide means mounted to said frame and having opposite end portions, each said guide means being operatively coupled at one said end portion to said other end portion of respective said cable, each said guide means including selection means for selectively connecting one or more of said weights in a respective said weight stack means to respective said guide means.

26. In the exercise device as defined in claim 25 wherein each said weight includes an upper surface and a lower surface and a vertical passageway communicating therebetween, said guide means being disposed within said passageway of each said weight.

27. In the exercise device as defined in claim 26 wherein said guide means and said passageways are spaced sufficiently to provide clearance between said guide means and said weights.

28. In the exercise device as defined in claim 26 further comprising positioning means mounted to said frame to inhibit lateral and pivotal movement of each said guide means.

29. In the exercise device as defined in claim 25 wherein each said guide means includes an elongated guide rod having an upper end portion and a lower end portion, said lower portion of said guide rod being bifurcated to a fork with a pair of spaced elongated elements each having upper and lower end portions, each said weight having opposite sides, each said element of respective said pair being disposed closely adjacent a respective said side of each said weight of said weight stack means.

30. In the exercise device as defined in claim 29 wherein each said pair of said elements are spaced sufficiently to provide clearance between respective said elements and said sides of said weights.

31. In the exercise device as defined in claim 29 wherein said upper end portion of said fork is formed as a horizontally disposed bar, said bar providing a seat for receiving an uppermost said weight in each respective said weight stack means, said bars being spaced a sufficient distance to maintain said uppermost weight in a horizontal position.

32. In the exercise device as defined in claim 29 further comprising positioning means mounted to said frame to inhibit lateral and pivotal movement of each said guide rod.

33. In the exercise device as defined in claim 32 wherein said positioning means includes linear bearing means, said linear bearing means including a housing mounted rigidly to said lower portions of said elements, said linear bearing means including an elongated shaft rigidly mounted to said frame.

34. In the exercise device as defined in claim 28 wherein said positioning means includes roller bearing means mounted on said frame, said roller bearing means permitting only linear movement of said guide rod.

35. In the exercise device as defined in claim 10 wherein said each elongated means includes at least one guide rod for selectively attaching one or more said weights to said respective guide rod, linear bearing means connected between and to said frame and respective said guide rod for inhibiting rotational movement of said guide and only permitting linear movement of said guide rod.

36. In the exercise device as defined in claim 10 wherein each said weight has an upper surface and a lower surface, one said surface of said weight including at least one outwardly disposed boss, another said surface having at least one complemental indentation positioned to receive respective said boss on an adjacent said weight, said bosses and said indentations cooperating as interlocks to inhibit lateral and pivotal motion of said weights.

37. In the exercise device as defined in claim 36 wherein said elongated means each includes a bracket seated against said boss on said exposed surface of an uppermost said weight in each said weight stack for inhibiting lateral and pivotal motion of said weight with respect to other said weights.

38. In the exercise device as defined in claim 36 wherein each said weight includes another boss and another indentation spaced from respective said at least one said boss and said indentation.

39. In the exercise device as defined in claim 10 further comprising a range of motion adjustment means to select the initial position of said exercise means.

40. In the exercise device as defined in claim 10 wherein said support frame includes stop means to limit the pivotal movement of said cam means assembly.

41. In the exercise device as defined in claim 10 wherein said weight stack means rests on a horizontal elevated member of said members of said support frame and an interlock means positioned between said elevated member and a lowermost said weight in each said weight stack means to inhibit lateral and pivotal movement of said lowermost weight.

42. In the exercise device as defined in claim 26 wherein said weights have a pair of sidewalls and a horizontally disposed passageway communicating between said sidewalls, each said guide means having a plurality of spaced vertically aligned passageways therethrough, said selection means including a selection pin sized to fit through said passageway in one said weight and through said passageway in said guide means to secure said weight to said guide means, said secured weight and any said weights supported vertically thereon being operatively connected to said cam means when said pin is placed through aligned said passageways of said weight and said guide means.

43. In the exercise device as in claim 28 wherein said weights have a pair of sidewalls and a horizontally disposed passageway communicating between said sidewalls, each said element having a plurality of spaced vertically aligned passageways therethrough with such passageways being horizontally aligned, said selection means including a selection pin sized to fit through said passageway in one said weight and through said passageway in said elements to secure said weight to said elements, said secured weight and any said weights supported vertically thereon being operatively connected to said cam means when said pin is placed through said aligned passageways of said weight and each of said elements.

44. In the exercise device as defined in claim 17 wherein a selected weight of one said weight stack means is dominant through a first range of pivotal movement of said cam means, and a selected weight of another said weight stack means being dominant through a second range of pivotal movement of said cam means.

45. In the exercise device as defined in claim 10 wherein each said weight stack means is operatively connected to said cam means in a manner such that each said selectable weights of respective weight stack means are lifted vertically when said exercise means is moved through said predetermined distance.

46. In the exercise device as defined in claim 10 wherein at least one said weight stack means is operatively connected to said cam means in a manner such that said selectable weights of said one weight stack means are lowered vertically when said exercise means is moved through said predetermined distance.

47. In the exercise device as defined in claim 10 wherein one said weight stack means is operatively connected to said cam means in a manner such that said selectable weights of said one weight stack means are lifted vertically when said exercise means is moved through said predetermined distance, the other said weight stack means being operatively connected to said cam means in a manner such that said selectable weights of said other weight stack means are lowered vertically when said exercise means is moved through said predetermined distance, said other weight stack means being a counterweight to said one weight stack means.

48. In an exercise device including a support frame having a plurality of rigidly secured members, at least one manually operable exercise means mounted to said frame in a manner to allow for movement thereof through a predetermined distance, at least one cam means pivotally mounted to said frame for movement of said cam means about a pivot axis when said exercise means is manually operated, at least one weight stack means including a plurality of selectable weights, an elongated means for operatively connecting said weight stack means to said cam means for movement of said selected weights of said weight stack by pivotal movement of said cam means, connection means for connecting said elongated means to said cam means, said elongated means including a cable means having opposite end portions, said cable being connected at one said end portion by said connection means to said cam means and connected at another said end portion to said weight stack means, the improvement comprising a guide means mounted to said frame and having opposite end portions, said guide means being operatively coupled at one said end portion to said other end portion of said cable, said guide means including selection means for selectively connecting one of said weights in said weight stack means to said guide means and any of said weights above said one weight being carried by said one weight, said guide means being spaced sufficiently from each said weight to provide a friction-free movement of said guide means with respect to said weights, and positioning means mounted to said frame to inhibit lateral and pivotal movement of said guide means, said positioning means including bearing means engaging another said end portion of said guide means in a manner to allow friction-free movement of said guide means with respect to said weights.

49. In the exercise device as defined in claim 48 wherein each said weight includes an upper surface and a lower surface and a vertical passageway communicating therebetween, said guide means being disposed within said passageway of each said weight and being located medially within and spaced from said passageway.

50. In the exercise device as defined in claim 48 wherein said guide means includes a guide rod having an upper end portion and a lower end portion, said lower portion of said guide rod being bifurcated to form a fork with a pair of spaced elements having upper and lower end portions, each said weight having opposite sides, each said element of respective said pair being spaced sufficiently from each said weight to provide a friction-free movement of said guide means with respect to said weights.

51. In the exercise device as defined in claim 48 wherein each said weight has an upper surface and a lower surface, one said surface including at least one outwardly disposed boss, said other surface including at least one complemental indentation positioned to receive respective said boss on an adjacent said weight, said bosses and said indentations cooperating as interlocks to inhibit lateral and pivotal motion of said weights.

52. In an exercise device comprising a support frame including a plurality of rigidly secured members, at least one manually operable exercise means mounted to said frame in a manner to allow for movement thereof through a predetermined distance, at least one cam means pivotally mounted to said frame for movement of said cam means about a pivot axis when said exercise means is manually operated, a plurality of weight stack means each including a plurality of selectable weights, connection means for operatively connecting each said weight stack means to said cam means for independent movement of respective weight stack means by pivotal movement of said cam means, said cam means having a profile formed to provide a plurality of distinct cam phases having lift, each said weight stack means being independently operable in response to a respective said cam phase, the lift of each said phase independently defining the movement of respective said weight stack means as said cam means is rotated through said predetermined distance.

53. In the exercise device as defined in claim 52 wherein at least one said cam phase provides that the velocity of movement of at least one said weight stack means will differ from the velocity of movement of at least another said weight stack during at least one distinct portion of said predetermined distance.

54. In the exercise device as defined in claim 52 wherein said cam means provides that the weight of one said weight stack means will be dominant during at least one specific portion in said predetermined distance.

55. In the exercise device as defined in claim 52 wherein said cam means includes a plurality of cam elements rigidly affixed together, each said element defining one said cam phase.

56. An exercise device comprising a support frame including a base and a plurality of rigidly connected members, first and second exercise means each movably mounted to said frame; first and second split phase cams rigidly mounted on respective said exercise means and pivotable about a pivot axis through a predetermined distance when said respective exercise means is moved, a first and second stack of selectable weights each including a plurality of planar weight plates, each said stack of weights being positioned on one said member of said frame generally parallel to and spaced above said base, a first and second cable and pulley assembly mounted on said support frame for connecting said first weight stack to said first and second split phase cams, respectively, each said first and second split phase cams including an upper and lower cam element formed to have a profile defining a respective upper and lower cam phase which are mounted in partial superposition about respective said cam pivot axis, said first cable and pulley assembly being connected at first points on respective said upper cam elements of said first and second split phase cams and said second cable and pulley assembly being connected at second points on respective said lower cam elements of said first and second split phase cams, said first and second connection points defining a respective first and second pair of moment arms with respect to the cam pivot axis of respective said upper and lower cam phases.

57. In the exercise device as defined in claim 56 wherein said upper and lower cam phases define the variation of respective said first and second pair of moment arms throughout said predetermined distance, one said pair of moment arms varying from an initial maximum value to a minimum value and said other pair of moment arms vary from an initial minimum value to a maximum value as said first and second split phase cams are rotated through said predetermined distance.

58. In the exercise device as defined in claim 57 wherein said upper and lower cam phases define the velocity of movement of respective said weight stack throughout said predetermined distance, the velocity of one said weight stack being greater than the velocity of the other said weight stack during at least one distinct portion of said predetermined distance.

59. In the exercise device as defined in claim 56 further comprising a pair of guide means mounted to said frame and having opposite end portions, each said guide means being operatively coupled at one said end portion to respective first and second cable and pulley assembly, each said guide means including selection means for selectively connecting one of said weights in respective said first and second stack of weights to respective said guide means and any weights above said one weight being supported on and by said one weight, each said weight includes an upper surface and a lower surface and a passageway communicating therebetween said guide means being disposed within said passageway of each said weight in respective said stack of weights, each said guide means and respective said passageways are spaced sufficiently to provide clearance between said guide means and respective said weights.

60. In the exercise device as defined in claim 59 further comprising positioning means mounted to said frame to inhibit lateral and pivotal movement of each said guide means.

61. In the exercise device as defined in claim 56 further comprising interlock means between adjacent said weights to maintain said weights in each said stack in vertical alignment throughout respective said stack.

62. In the exercise device as defined in claim 56 wherein each said weight includes a horizontally extending passageway through opposing sides of each said weight, further comprising guide means connected respectively to said first and second assemblies for respective said stack of weights, each guide means including a pair of elongated spaced elements on respective said opposing sides of respective said weights of respective said stacks of weights, each said pair of elements having a plurality of spaced horizontally aligned passageways, selection means for each said weight stack including a pin positionable in said aligned passageways of respective said pair of elements and said passageways in one said selected weight in each said stack of weights.

63. In the exercise device as defined in claim 62 further comprising a pair of bearing means attached between said elements and said frame to inhibit any movement of said elements other than vertical movement.

64. In an exercise device comprising a support frame including a plurality of rigidly secured members, at least one manually operable exercise means mounted to said frame in a manner to allow for movement thereof through a predetermined distance, at least one cam means mounted to said frame for movement of said cam means when said exercise means is manually operated, a plurality of weight stack means each including a plurality of selectable weights, connection means for operatively connecting each said weight stack means independently to said cam means for movement of respective weight stack means by movement of said cam means, said cam means having a profile formed to provide a plurality of distinct cam phases having lift, each said weight stack means being independently operable in response to a respective said cam phase, the lift of each said phase defining the movement of respective said weight stack as said cam means is moved through said predetermined distance.

* * * * *